United States Patent [19]

Sakai et al.

[11] Patent Number: 4,934,159

[45] Date of Patent: Jun. 19, 1990

[54] ICE MAKING MACHINE

[75] Inventors: Tadashi Sakai; Shinobu Kojima; Takashi Morishita, all of Toyoake, Japan

[73] Assignee: Hoshizaki Electric Co., Ltd., Toyoake, Japan

[21] Appl. No.: 367,710

[22] Filed: Jun. 19, 1989

[30] Foreign Application Priority Data

Jun. 23, 1988 [JP] Japan ..... 63-153554

[51] Int. Cl.[5] ..... F25C 1/12

[52] U.S. Cl. ..... 62/347

[58] Field of Search ..... 62/347, 348, 74

[56] References Cited

U.S. PATENT DOCUMENTS 4,617,806 10/1986 Sakai et al. ..... 62/347

FOREIGN PATENT DOCUMENTS 10947 1/1977 Japan ..... 62/347

*Primary Examiner*—William E. Tapolcai

*Attorney, Agent, or Firm*—Wenderoth, Lind & Ponack

[57] ABSTRACT

An ice making machine has an ice making unit including an evaporator, a water tank for containing raw water to be iced, a water distributor for supplying the water to the ice making unit, a circulation pump in fluid communication with the water tank and the water distributor for supplying water from the water tank to the water distributor during an icing operation, a water supply system for supplying water to the water tank, a sub-tank fluidly communicated with the water tank, and a water level control device disposed within the sub-tank for monitoring the water level therein to detect a predetermined water level. A flushing pipe for supplying a washing water to the sub-tank is connected thereto through an air supply device.

3 Claims, 4 Drawing Sheets

ICE MAKING MACHINE

CROSS REFERENCES TO RELATED APPLICATIONS

This application is related to U.S. Application Ser. Nos. 71,260 filed Jul. 8, 1987 now abandoned entitled "Water Supply System for Ice Making Machine" and 167,155 filed Mar. 16, 1988 now U.S. Pat. No. 4,869,076 "Water Supply System for Ice Making Machine" both of which are incorporated by reference herein.

BACKGROUND OF THE INVENTION

1. Field of the Invention

The present invention relates generally to an ice making machine and more particularly to an automated ice making machine provided with a water level control device which is disposed within a sub-tank in fluid communication with an icing water tank to detect the water surface level within the icing water tank.

2. Description of the Prior Art

An example of an automated ice making machine of the type mentioned above has already been proposed, as in Japanese Patent Application Laid-Open No. 291,876/1986 (JP-A-No. 61-291,876) filed in the name of the inventor of the present application. FIG. 4 in the accompanying drawings shows a general arrangement of a water flow system incorporated in the prior art ice making maching mentioned above. In this figure, reference numeral 1 denotes an ice making plate equipped with an evaporator pipe 2 mounted thereon in a meandering pattern. An icing water tank 4 containing icing water (i.e. water to be transformed into ice) is disposed beneath the ice making plate 1 with a dropping water guide plate 3 being interposed therebetween. Provided in fluid communication with the icing water tank 4 is a water circulation pump 5 which serves to circulate the icing water during the freezing or icing mode so that the water is distributed over a surface of the ice making plated 1 from an icing water distributor 6 disposed above the ice making plate 1.

On the other hand, a water supply valve 7 connectable to a water supply source such as an external water service system is connected to a second defreezing or deicing water distributor 9 through a T-joint 8. Extending downwardly from the leg of the T-joint 8 is a flush pipe 10 which is connected to a connector pipe 12 of a sub-tank 11 provided in fluid communication with the icing water tank 4. In a deicing operation mode, the water supply valve 7 is opened, whereby water from the water service system is distributed over the rear surface of the ice making plate 1 from the second water distributor 9 and at the same time is supplied to the sub-tank 11 by way of the flushing pipe 10. The deicing water distributed over the rear surface of the ice making plate 1 drops into the icing water tank 4 through the guide plate 3 to be collected therein as the water to be iced in the succeeding ice making cycle. On the other hand, the water supplied to the sub-tank 11 washes it and thence flows into the icing water tank 4 through the connector pipe 13. A major part of water flowing into the icing water tank 4 is discharged outwardly through an overflow pipe 14.

The upper limit of the water level within the icing water tank 4 is defined by the overflow pipe 14. During the icing operation cycle, water within the icing water tank 4 is circulated by the circulation pump 5 to be supplied to the ice making plate assembly 1, with result in that crescent-shaped ice pieces 15 are formed on the front surface of the ice making plate 1 and grow progressively in the course of time. When the ice pieces have grown to a certain size, the amount of water within the tank 4 has been decreased by an amount corresponding to the water consumed in forming the ice pieces. Since the icing water tank 4 is in fluid communication with the sub-tank 11 through the connecting pipea 13, the water level within the latter is also lowered correspondingly. Consequently, the water surface within the connector tube 12 which had been at a considerably higher level at the start of the icing operation cycle, as shown in FIG. 5 of the accompanying drawings, is progressively lowered down to a level where the water surface lies below the bottom end 12*a* of the connector pipe 12. At that time, a chamber 16 defined within the sub-tank 11 and hermetically closed until then is opened to the atmosphere through a vent orifice (not shown) formed in the joint 8. As a result, a float 17 is caused to move downwardly. When the float 17 has attained a predetermined position, a magnet 18 mounted on the float 17 actuates a reed switch 19, whereby a signal indicating completion of the ice making operation is generated to thus bring the icing operation cycle to an end.

In the prior art ice making machine described above, such an arrangement is adopted so that impurities sedimented and deposited within the sub-tank 11 are driven into the icing water tank 4 through the connecting pipe 13 under the washing action by a part of the deicing water flowing into the sub-tank 11 through the flushing pipe 10 during the deicing operation cycle. In practice, however, there may arise such a situation in which the deicing water can not be supplied to the sub-tank 11 in amounts great enough to drive or carry the impurities into the icing water tank 4 because of flow resistance presented by the joint 8 as well as for other reasons. This problem may be solved by increasing the flow of water through the water supply valve 7 thereby increasing the water supply to the sub-tank 11. In that case, however, the amount of deicing water dropping into the icing water tank 4 from the ice making plate 1 is naturally increased, with the result that the amount of water discharged outwardly through the overflow pipe 14 is also increased, which in turn means that water consumption is wastefully increased, giving rise to other problems.

SUMMARY OF THE INVENTION

It is therefore an object of the present invention to provide an ice machine of a structure that is capable of effectively washing away the impurities from a sub-tank without the accompanying wasteful consumption of water.

With the above object in view, there is provided according to an aspect of the present invention an ice making machine of the type capable of repeating operations in an icing mode and a deicing mode, which machine comprises an ice making unit including an evaporator, an icing water tank to contain icing water therein, a water distributor for distributing the icing water to the ice making unit, a circulation pump in fluid communication with the icing water tank and the water distributor for supplying water from the icing water tank to the water distributor in the icing mode, water supply means for supplying icing water to the icing water tank, a sub-tank fluidly communicated with the icing water tank, and a water level control device disposed within the sub-tank for monitoring the water level therein to thereby detect a predeterimed water level, wherein a flushing pipe for supplying washing water to the sub-tank is connected thereto by way of an air supply means.

According to a first preferred embodiment of the present invention, the flushing pipe is branched from a pipe which connects a water supply valve constituting a part of washing water supply means and a deicing water distributor to each other. In a second preferred embodiment of the invention, a double-acting type circulation pump having two discharge openings is employed, wherein one of the discharge openings is placed in fluid communication with the icing water distributor while the other discharge opening is fluidly communicated with a washing/drain system from which the flushing pipe is branched. In each of the first and second embodiments, a restriction tube having a restricting orifice is provided between the flushing pipe and the sub-tank to serve as a part of the air supply means mentioned hereinbefore.

In the icing mode (i.e. ice making operation mode), the circulation pump circulates icing water (i.e. water to be transformed into ice) from the icing water tank to supply the water to the ice making unit through the icing water distributor while a coolant fed to the evaporator at that time in a manner known per se is cooling the ice making unit. Thus, the icing water as distributed is progressively cooled down to form ice on the ice making unit, which ice grows to ice pieces. In the meanwhile, the water height within the icing water tank and the sub-tank is progressively lowered to reach a predetermined level, which is detected by the water surface control or monitor device, whereupon a detection signal indicating completion of the ice making operation is generated. In response to the detection signal, operation of the ice making machine is changed over to the deicing mode from the icing mode.

At this stage, there remains, within the icing water tank and the sub-tank, water having an impurity concentration increased during the icing mode.

Upon starting of the deicing operation mode, the evaporator incorporated in the ice making unit is supplied with a hot gas to melt the ice pieces at the portions contacting the ice making unit, whereby the ice pieces detach from the latter.

In the meantime, the sub-tank is supplied with washing water through the flushing pipe branched from the conduit having the water supply valve installed therein in the case of the first embodiment of the invention or through the flushing pipe connected to other discharge opening of the reversible pump. Since the air supply means composed of the restriction tube having the restricting orifice is provided in the flushing pipe, a negative pressure is generated within a space located downstream of the orifice upon passage of the washing water therethrough, whereby the air is drawn into washing water. Thus, the sub-tank is supplied with air bubbles together with washing water. The presence of the air bubbles mixed in the washing water effectively reduces the flow section of the washing water because a part of the flow path of the washing water is taken up by the air bubbles. As a result, the flow speed of the washing water is increased to cause intensive turbulence due to increased difference in flow speed between the air bubbles and the washing water, whereby water resident within the sub-tank is subjected to agitation. In this way, the interior of the sub-tank can be cleaned with a small amount of washing water.

BRIEF DESCRIPTION OF THE DRAWINGS

Preferred embodiments of the invention will now be described, by way of example only, with respect to the accompanying drawings, in which.

DESCRIPTION OF THE PREFERRED EMBODIMENTS

Now, the invention will be described in detail by way of preferred or exemplary embodiments by reference to the accompanying drawings, throughout which the same reference symbols denote like or equivalent parts.

Figure 1:
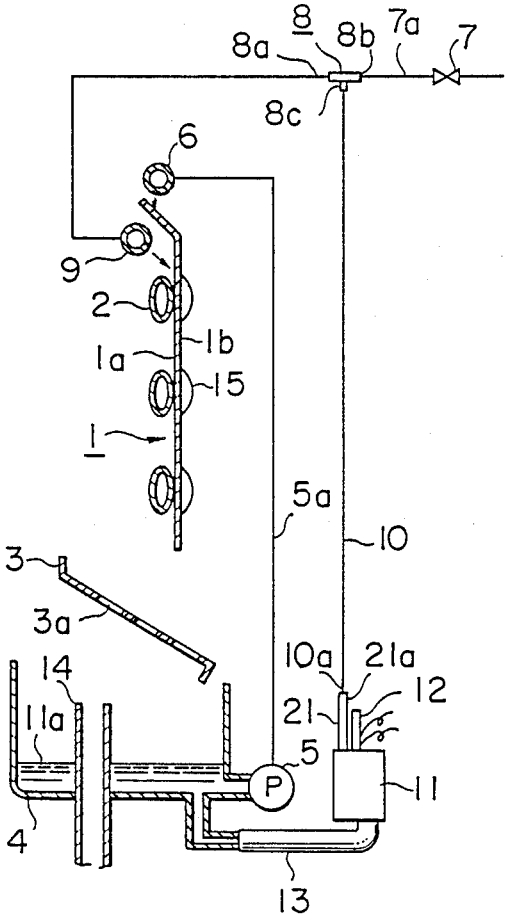
FIG. 1 is a schematic elevational view showing a general arrangement of an ice making machine according to a first embodiment of the invention.

Referring to FIG. 1, there is shown a general arrangement or structure of a preferred embodiment of the ice making machine according to the invention. In this ice making machine, an ice making unit disposed in a substantially vertically upstanding posture includes an ice making plate 1 and a meandering evaporator pipe (evaporator) 2 mounted on a rear surface 1*a* of the ice making plate 1. The evaporator pipe 2 is supplied with a coolant circulated in a manner well known to those skilled in the art for cooling the ice making plate 1, whereby water flowing downwardly on and along a front surface 1*b* of the plate 1 is progressively cooled down. In the course of flowing downwardly, a part of the water is frozen into ice which grows to form ice pieces 15.

Disposed at an inclination beneath the ice forming plate 1 is a perforated guide plate 3 in which holes or openings 3*a* are formed of such a size that water dropping from the ice making plate 1 can pass those openings 3*a* while ice pieces or pellets 15 are prevented from passing therethrough. The ice pieces are guided into an ice storage box (not shown) along the guide plate 3.

An icing water tank 4 for containing water to be iced is provided with an overflow pipe 14 which serves to set the upper limit of the water level within the tank 4 and a water circulartion pump 5 and additionally a sub-tank 11 is connected to the tank 4 through a connecting pipe 13. The circulation pump 5 has a discharge opening or port communicated through a pipe 5*a* with a first water distributor (distributor for icing water) 6. During operation in the ice making mode, the circulation pump 5 is operated, whereby a part of the water distributed over the ice making plat 1 from the first distributor 6 and remaining unfrozen is recovered into the icing water tank 4 through the guide plate 3, as will be described in more detail hereinafter.

In the deicing operation mode of the ice making machine according to the invention, the ice pieces 15 grown on the front surface 1*b* of the ice making plate 1 are melted at portions contacting the surface 1*b* under the action of a hot gas flowing through the evaporator pipe 2 in a well known manner in cooperation with deicing water distributed over the rear surface 1*a* of the ice making plate 1, whereby the ice pieces 15 are detached from the latter. To this end, a second water distributor (deicing water distributor) 9 is disposed at a location above the rear surface 1*a* of the icing plate 1 and communicated with a pipe 7*a* having a water supply valve (water supply means) 7 connected to an exterior water supply source (not shown). Deicing water distributed from the second distributor 9 during the deicing operation cycle is collected in the icing water tank 4 through the guide plate 3, as will be described in more detail hereinafter.

The pipe 7*a* has a T-joint 8 installed therein at a location downstream of the water supply valve 7 and having, in addition to ports 8*a* and 8*b*, a port 8*c* to which a flushing pipe 10 for washing the sub-tank 11 is connected, as with the case of the prior art ice making machine. The structure of the sub-tank 11 is shown in detail in FIG. 2, while that of the joint 8 is shown in FIG. 2A.

Figure 2:
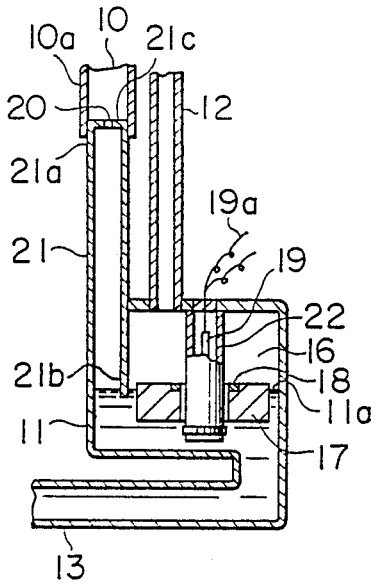
FIG. 2 is a sectional view showing in detail a structure of a sub-tank incorporated in the ice making machine shown in FIG. 1.
Figure 2A:
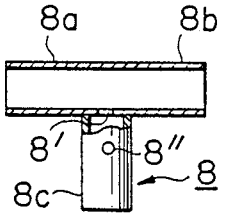
FIG. 2A is a sectional view showing in detail a structure of a joint installed in a deicing water supply pipe of the ice making machine shown in FIG. 1.

The joint 8 should preferably be so implemented as to have a branching bore 8' and a vent orifice 8'', as shown in FIG. 2A and disclosed in JP-A-No. 61-291876.

Further, referring to FIGS. 1 and 2, a connector pipe 13 is fluidly communicated at the respective ends with the icing water tank 4 and the sub-tank 11 at the bottoms thereof, respectively. The flushing pipe 10 mentioned above has a lower end portion 10*a* snugly fitted in a top end portion 21*a* of a restriction pipe (constituting a part of the air supply means) 21 which extends upwardly from the sub-tank 11. The lower end 21*b* of the restriction pipe 21 extends into the sub-tank 11 at a position which substantially corresponds to a mid point along the height of the sub-tank 11, i.e. to a position located slightly lower than the water level 11*a* prevailing within the sub-tank 11 at the time when the icing operation has been completed, as can be seen in FIG. 2. It is to be noted that although the restriction pipe 21 is opened fully at the bottom end, it has a top end wall 21*c* formed with an orifice (constituting a part of the air supply means) 20. Further disposed in the vicinity of the restriction pipe 21 is a vent pipe 12 which extnds vertically upwardly and is communicated with the atmosphere, as can be seen in FIG. 2. Under the action of this pipe 12, the water level within the sub-tank 11 is maintained substantially at the same height as the water level within the icing water tank 4.

The diameter of the orifice 20 is experimentally determined so that the water forced therethrough when water supply valve 7 is opened will be mixed with air within an air chamber defined within the restriction tube 21 below the orifice 20 and the water with air bubbles therein will be gradually driven into the interior of the sub-tank 11 upon flushing thereof by the washing water, as described hereinafter. For example, where the flushing or cleaning piep 10 is designed to have an inner diameter of 10 mm, the orifice diameter is preferably about 2.5 mm. This size will produce the desired mixing and will allow sufficient water to pass to create the amount of agitation in the sub-tank 11 to effect the discharge of the major amount of impurities from the sub-tank.

As in the case of the conventional ice making machine described hereinbefore by reference to FIG. 1, there is disposed within the chamber 16 of the sub-tank 11 a liquid level control or monitor device which is composed of an annular float 17, a magnet 18 mounted on the float 17 along the inner periphery thereof and a reed switch 19 adapted to be actuated by the abovementioned magnet 18 at the time when the water surface within the chamber 16 has attained the water level 11*a*. Further, in order to guide the vertical movement of the float 17 in response to the change in the water level within the chamber 6, a cylindrical guide member 22 is suspended from the top wall of the sub-tank 11 and extends through the annular float 17. The reed switch 19 is accommondated within the guide member 22, the lead wires 19*a* of the reed switch 19 being connected to a control circuit (not shown) of the ice making machine.

With the structure of the ice making machine described above, the water valve 7 is opened at the start of the deicing operation, whereby the deicing water is distributed over the rear surface of the icing plate 1 from the second distributor 9 while at the same time the water fed through the valve 7 is supplied as the washing water into the sub-tank 11 through the flushing pipe 10 and the restriction tube 21. Thus, the water closes the orifice 20 to thereby form a hermetically closed air chamber within the restriction tube 21, whereupon the air within the hermetically closed chamber is gradually driven toward and into the sub-tank 11 together with the washing water.

Normally, the icing mode operation is performed in precedence to the deicing mode. Accordingly, the water remaining within the sub-tank 11 at the end of the icing operation cycle has an increased concentration of impurities, which water undergoes agitation by the washing water flowing into the sub-tank 11 and carrying the air bubbles upon starting of the deicing cycle. The agitation is intensified by the fact that the sub-tank 11 is so designed as to have as small a capacity as possible. Due to such agitation, the interior of the sub-tank 11 is washed or cleaned of impurities within a relatively short time. The washing water is then driven into the icing water tank 4 through the connecting pipe 13 to be diluted therein, while a major part of the washing water is discharged through the overflow pipe 14 during the deicing operation.

Figure 3:
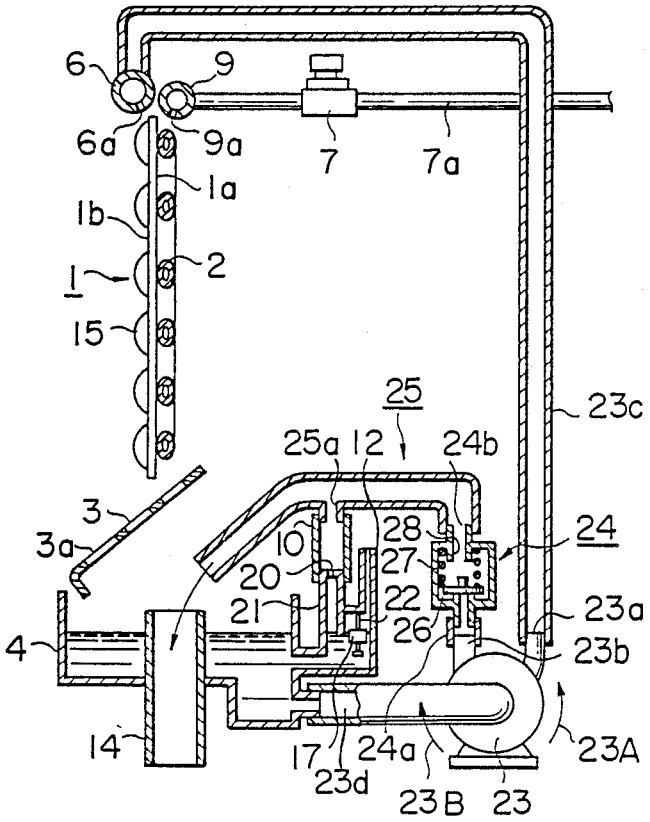
FIG. 3 is a schematic elevational view showing a general arrangement of an ice making machine according to a second embodiment of the invention.
Figure 4:
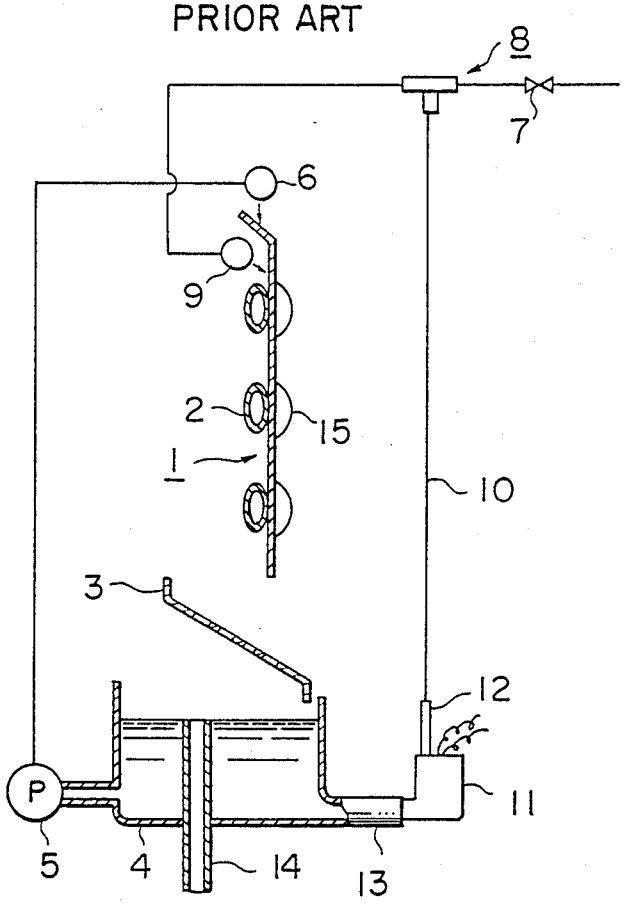
FIG. 4 PRIOR ART
FIG. 4 is a schematic elevational view showing a structure of an ice making machine known heretofore.
Figure 5:
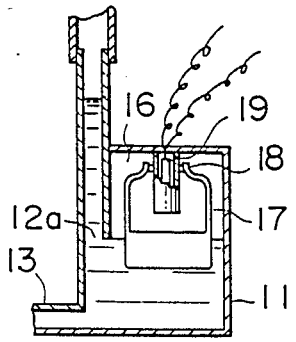
FIG. 5 PRIOR ART
FIG. 5 is a sectional view showing in detail a structure of a sub-tank incorporated in the ice making machine shown in FIG. 4.

FIG. 3 shows a modified embodiment of the invention applied to the ice making machine of the type disclosed in U.S. patent application Ser. No. 71,260 mentioned hereinbefore. In the case of the ice making machine according to the first embodiment of the invention, the flushing pipe 10 is branched through the joint 8 from the conduit having the water supply valve 7 installed therein for the purpose of washing the sub-tank 11. However, in the case of the ice making machine disclosed in the above-mentioned U.S. patent application Ser. No. 71,260, a reversible circulating pump is employed which is adapted to rotate in the forward direction during the icing operation to feed the icing water from one discharge opening, while in the deicing mode of operation, the pump rotates in the backward or reverse direction to supply a part of the deicing water to a sub-tank from the other discharge opening. Although the general structure of such reversible pump is believed to be apparent from the following description, reference may be made to the above-mentioned U.S. Patent Application for details thereof, if necessary.

Referring again to FIG. 3, the circulation pump 23 having an intake port 23*d* connected to the water tank 4 is of a double acting type reversible pump having two discharge openings, wherein one discharge opening 23*a* is connected to an icing water supply pipe 22*c* while the other discharge opening 23*b* is connected to a washing/drain system generally denoted by a reference numeral 25 by way of an interposed pressure-responsive valve 24. The latter includes a valve housing having an inlet port 24*a* communicated with the discharge opening 23*b* of the reversible pump 23 and an exit port 24*b* connected to the washing/drain system 25, wherein a valve element 26 is disposed within the valve housing, being resiliently urged by a spring 27 in the direction to close the inlet port 24*a*. A stopper 28 is formed in the valve housing in the vicinity of the exit port 24*b* for thereby preventing the exit port 24*b* from being closed by the valve element 26 upon rotation of the pump 23 in the reverse direction, as described hereinafter.

Branched from a branching portion 25*a* formed at an intermediate location of the washing/drain system 25 having a tip end opened facing an open top end of the overflow pipe 14 is a flushing pipe 10 which has a lower end portion snugly fitted in a restriction pipe 21 upstanding from the sub-tank 11. It should be noted that an orifice 20 is formed in the top wall of the restriction pipe 21 the same as the orifice 20 in the embodiment of FIGS. 1-2A. There is also disposed within the sub-tank 11 a water level control device which includes a float and associated parts for detecting the lowering of the water surface within the sub-tank 11 to a predetermined level during the icing operation mode for the purpose of generating a signal indicating completion of the icing operation, as in the case of the first embodiment described hereinbefore with reference to FIGS. 1 and 2. It goes without saying that although only the float 17 and the cylindrical guide member 22 are shown in FIG. 3, a magnet and a read switch are also provided, as described in conjunction with the first embodiment.

Now, a description will be given of operation of the ice making machine according to the second embodiment of the invention. Upon closing a main switch for applying the electric power, the operation of the ice making machine in the deicing mode is started, whereupon the water supply valve 7 is opened to allow deicing water to be distributed over the rear surface of the ice making plate 1 from a plurality of orifices 9*a* of the second distributor 9, the deicing water flowing down over and along the ice making plate 1 being collected within the icing water tank 4 through the perforated guide plate 3 and discharged through the overflow pipe 14 mounted within the water tank 4.

Upon transition to the icing mode of operation at the end of the deicing operation cycle, the reversible pump 23 is driven in the direction indicated by an arrow 23A. As the result, the water stored within the tank 4 up to the highest level delimited by the overflow pipe 14 is transported to the first water distributor 6 through the first discharge opening 23*a* of the pump 23 and the pipe 23*c* to be supplied over the front surface of the ice making plate 1 from the orifices 6*a* of the first water distributor 6.

During the icing operation, a fraction of the water is also discharged from the second discharge openings 23*b* to apply a hydraulic pressure to the valve element 26. However, since the valve element 26 is resiliently urged in the direction to close the discharge opening 23*b* under the action of the spring 27, any transportation of water to the washing/drain system 25 is positively inhibited.

As the operation of the ice making machine in the icing mode proceeds, the water circulated by the pump 23 is progressively cooled down to start formation of ice on the ice making plate 1. As the ice grows, water corresponding amount of r is consumed, resulting in the water level within the tank 4 and thence within the sub-tank 11 being lowered with the float 17 being displaced downwardly. When the float has attained a level that corresponds to the ice having grown to ice pieces 15 of a predetermined size, the magnet and the reed switch (both not shown) cooperate to generate a signal indicating completion of the ice making cycle. In response to this signal, operation of the ice making machine is changed over to the deicing mode from the icing mode.

At the beginning of the deicing operation mode, an impeller (not shown) of the reversible pump 23 is rotated in the direction indicated by an arrow 23B, whereby the water remaining within the tank 4 and having an increased impurity concentration is transported to the washing/drain system 25 through the second discharge opening 23*b* of the pump 23 and the pressure-responsive valve 24, a part of the water being discharged outwardly through the overflow pipe 14, while the other part of the water is supplied to the sub-tank 11 by the flushing pipe 10 and the restriction pipe 21. The water flowing through the orifice 20 of the restriction pipe 21 is forced to contain air bubbles. Thus, the water carrying the air bubbles is supplied to the sub-tank 11, resulting in turbulence and agitation taking place in the water resident within the sub-tank 11, whereby the sub-tank is effectively washed or cleaned or impurities. Consequently, the float and other parts are protected from malfunction which may otherwise be brought about by sedimentation and deposition of those impurities.

In the foregoing description of the ice making machines according to two embodiments of the invention, it has been assumed that a float switch is employed to serve as the water surface or level control device. It should, however, be appreciated that the invention is never restricted to such arrangement, but can equally be applied to an ice making machine of a type in which the water surface or level is controlled with the aid of, for example, an electrode array well known in the art.

Further, although the foregoing description has been made on the assumption that the ice making includes the vertically disposed ice making plate, it is apparent that the present invention can equally be applied to any given type of ice making machine so far as a liquid surface control device is disposed within a sub-tank communicated with an icing water tank, which sub-tank is provided with a flushing pipe for washing or cleaning it.

In conjunction with the second embodiment of the ice making machine according to the invention, it has been described that the pressure-responsive valve 24 is provided in association with only the second discharge opening of the reversible circulation pump 23. It should however be understood that an additional pressure-responsive valve may be provided in association with the first discharge opening of the pump 23 to a similar effect.

As will now be apparent from the foregoing description, the provision of the air supply means in combination with the flushing pipe for supplying washing or cleaning water according to the teachings of the invention causes the water flow supplied to the sub-tank to include and carry the air bubbles. By virtue of this arrangement, the sub-tank can be cleaned of impurities suspended or deposited therein with a minimum amount of water consumption, whereby accurate or correct operation of the device for detecting completion of the ice making cycle can be insured.

It is thought that the invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What is claimed is:

1. An ice making machine of a type alternating operations between an icing mode and a deicing mode, said machine comprising:

an ice making unit including an evaporator;

a water tank for containing therein icing water to be transformed into ice;

an icing water distributor for supplying the icing water to said ice making unit;

a circulation pump provided in fluid communication with said icing water tank and said icing water distributor for supplying the icing water from said icing water tank to said icing water distributor during the icing mode of operation;

icing water supply means for supplying the icing water to said icing water tank;

a sub-tank fluidly communicated with said icing water tank;

means disposed within said sub-tank for monitoring the water level therein to detect a predetermined water level to control the water level;

a flushing pipe connected to said sub-tank for supplying a washing water thereto; and a restriction pipe having an orifice therein and provided between said flushing pipe and said sub-tank for supplying air into a flow of water through said restriction pipe, said orifice having a diameter sufficient for allowing a flow of water through said orifice sufficient to create an amount of agitation needed to effect the discharge of the major amount of impurities from said sub-tank.

2. An ice making machine according to claim 1, further including deicing water distributor means for distributing deicing water onto said ice making unit, deicing water supply means provided in fluid communication with said deicing water distributor means for supplying deicing water thereto, and a water supply valve installed in association with said deicing water supply means and adapted to be opened during the deicing mode, said flushing pipe being branched from said deicing water supply means at a location between said water supply valve and said deicing water distributor means.

3. An ice making machine according to claim 1, wherein said circulation pump is a double-acting type having two discharge openings, one being fluidly communicated with said icing water distributor means, and the other being fluidly communicated with a washing/drain system from which said flushing pipe is branched.

* * * * *